US007116043B2

(12) United States Patent
Tomiyoshi et al.

(10) Patent No.: US 7,116,043 B2
(45) Date of Patent: Oct. 3, 2006

(54) COMPACT SELF-BALLASTED FLUORESCENT LAMP WITH IMPROVED RISING CHARACTERISTICS

(75) Inventors: Yasushige Tomiyoshi, Takatsuki (JP); Shiro Iida, Kyoto (JP)

(73) Assignee: Matsushita Electric Industrial Co. Ltd., Osaka-Fu (JP)

( * ) Notice: Subject to any disclaimer, the term of this patent is extended or adjusted under 35 U.S.C. 154(b) by 163 days.

(21) Appl. No.: 10/786,519

(22) Filed: Feb. 25, 2004

(65) Prior Publication Data

US 2004/0232815 A1 Nov. 25, 2004

(30) Foreign Application Priority Data

Feb. 28, 2003 (JP) ..... 2003-055003

(51) Int. Cl.
*H01J 5/50* (2006.01)
*H01J 5/54* (2006.01)
*H01J 5/00* (2006.01)

(52) U.S. Cl. ..... 313/317; 313/318.01; 313/318.02; 313/634; 313/318.12; 439/611; 439/612; 439/226

(58) Field of Classification Search ..... 313/634, 313/493, 573, 318.01, 623–625, 611, 612, 313/226, 227
See application file for complete search history.

(56) References Cited

U.S. PATENT DOCUMENTS 4,871,944 A * 10/1989 Skwirut et al. ..... 315/56
5,296,780 A * 3/1994 Haraden et al. ..... 313/318.02
5,581,157 A * 12/1996 Vrionis ..... 315/117
5,629,586 A * 5/1997 Yasuda et al. ..... 313/344
5,675,215 A * 10/1997 Watson et al. ..... 313/318.02
5,705,883 A * 1/1998 Soules et al. ..... 313/318.09
5,751,104 A 5/1998 Soules et al.
2002/0158567 A1* 10/2002 Arakawa et al. ..... 313/492

FOREIGN PATENT DOCUMENTS

JP 08153489 A * 6/1996
JP 08222183 A 8/1996
JP 8-339780 12/1996
JP 09069309 A 3/1997
JP 10027515 A * 1/1998
JP 2005302444 A * 10/2005

* cited by examiner

*Primary Examiner*—Mariceli Santiago

(57) ABSTRACT

A compact self-ballasted fluorescent lamp includes a double-spiral arc tube formed by winding a glass tube to its both ends around a spiral axis, and sealing electrodes each having a filament coil at the ends of the glass tube, and a holding member that has a closed bottom and holds the arc tube. The holding member has, at its end wall, insertion openings through which the ends of the glass tube are inserted. The ends of the glass tube are inserted to such positions that enable the filament coils to be positioned within the holding member, and the minimum distance L, in the insertion direction of the ends of the glass tube, between the filament coil and the edge of the insertion opening of the holding member is 6 mm.

11 Claims, 9 Drawing Sheets

COMPACT SELF-BALLASTED FLUORESCENT LAMP WITH IMPROVED RISING CHARACTERISTICS

This application is based on application No. 2003-55003 filed in Japan, the contents of which are hereby incorporated by reference.

BACKGROUND OF THE INVENTION (1) Field of the Invention

The present invention relates to a compact self-ballasted fluorescent lamp including an arc tube composed of a glass tube at least partially bent and electrodes with filament coils sealed at both ends of the glass tube, and a holder having insertion openings and holding the arc tube by fixing the ends of the glass tube inserted through the insertion openings.

(2) Related Art

In the present energy-saving era, compact self-ballasted fluorescent lamps have been increasingly widespread as energy-saving light sources alternative to incandescent lamps. As one example, a compact self-ballasted fluorescent lamp includes an arc tube formed by winding a glass tube in a double-spiral shape and enclosing mercury in the glass tube, a holder holding the arc tube, an electronic ballast contained in the holder for lighting the arc tube, a globe covering the arc tube, and a screw-type base attached to the holder.

At both ends of the glass tube, electrodes with filament coils are sealed. The holder has a pair of insertion openings through which the ends of the glass tube are inserted in the holder. Some compact self-ballasted fluorescent lamps have such a construction where the arc tube is held by the holder in a state where the filament coils placed in the glass tube are positioned within the holder (see Japanese Laid-Open Patent Application No. H8-339780). To efficiently obtain visible light emitted from the arc tube, however, compact self-ballasted fluorescent lamps having such a construction where the filament coils are positioned outside the holder have been developed in recent years.

Compact self-ballasted fluorescent lamps with the construction where the filament coils are positioned outside the holder can feature an improved amount of light emission. After the cumulative lighting time of long hours, however, these lamps start to suffer from poor rising characteristics at the lighting startup compared with the initial stage of their use.

FIG. 1 shows the relationship between a relative luminous flux value and an elapsed lighting time for a conventional compact self-ballasted fluorescent lamp. The relative luminous flux value is a luminous flux value relative to a luminous flux value during the steady lighting state, at the lighting startup of the conventional compact self-ballasted fluorescent lamp. Here, the conventional compact self-ballasted fluorescent lamp is repeatedly made ON and OFF with its base being oriented upward, until a total lighting time reaches 100 hours and 6000 hours. The total lighting time is a total of ON times when a ON/OFF cycle of "two hours and 45 minutes ON" and "15 minutes OFF" is repeated.

As shown in the figure, for the conventional compact self-ballasted fluorescent lamp, the time required by the relative luminous flux value during the steady lighting state to reach 60% is about 7.5 seconds for the total lighting time of 100 hours, whereas the time is about 20.5 seconds for the total lighting time of 6000 hours. The time required by the relative luminous flux value to reach 60% for the total lighting time of 6000 hours is 2.7 times as long as that for the total lighting time of 100 hours. In this way, after the total lighting time of long hours, the lamp starts to suffer from poor rising characteristics at the lighting startup compared with the initial stage of its use.

SUMMARY OF THE INVENTION

In view of the above problem, the object of the present invention is to provide a compact self-ballasted fluorescent lamp with improved rising characteristics at the lighting startup after the cumulative lighting time of long hours while maintaining the emitted luminous flux.

The above object of the present invention can be achieved by a compact self-ballasted fluorescent lamp, including: an arc tube including a glass tube at least partially bent, and electrodes sealed at both ends of the glass tube, each electrode including a filament coil; and a holder having a pair of insertion openings formed therein, and holding the arc tube by fixing the ends of the glass tube inserted through the insertion openings, wherein the ends of the glass tube are inserted to such positions that enable each filament coil to be positioned within the holder, and a minimum distance L1, in an insertion direction of the ends of the glass tube, between each filament coil and an edge of corresponding one of the insertion openings is in a range of 0 to 10 mm inclusive.

According to this construction, the temperature at positions on the glass tube in the vicinity of the filament coils can be raised while the lamp can maintain substantially the same luminous flux as the luminous flux of conventional lamps. Accordingly, concentration of mercury in the vicinity of the filament coils can be suppressed, thereby preventing the amount of mercury present within the glass tube from being reduced. Due to this, even after the total lighting time of long hours, the lamp can have improved rising characteristics at the lighting startup.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF THE PREFERRED EMBODIMENT

The following describes a compact self-ballasted fluorescent lamp relating to a preferred embodiment of the present invention, with reference to FIGS. 2 to 7.

1. Construction (a) Overall Construction

Figure 1:
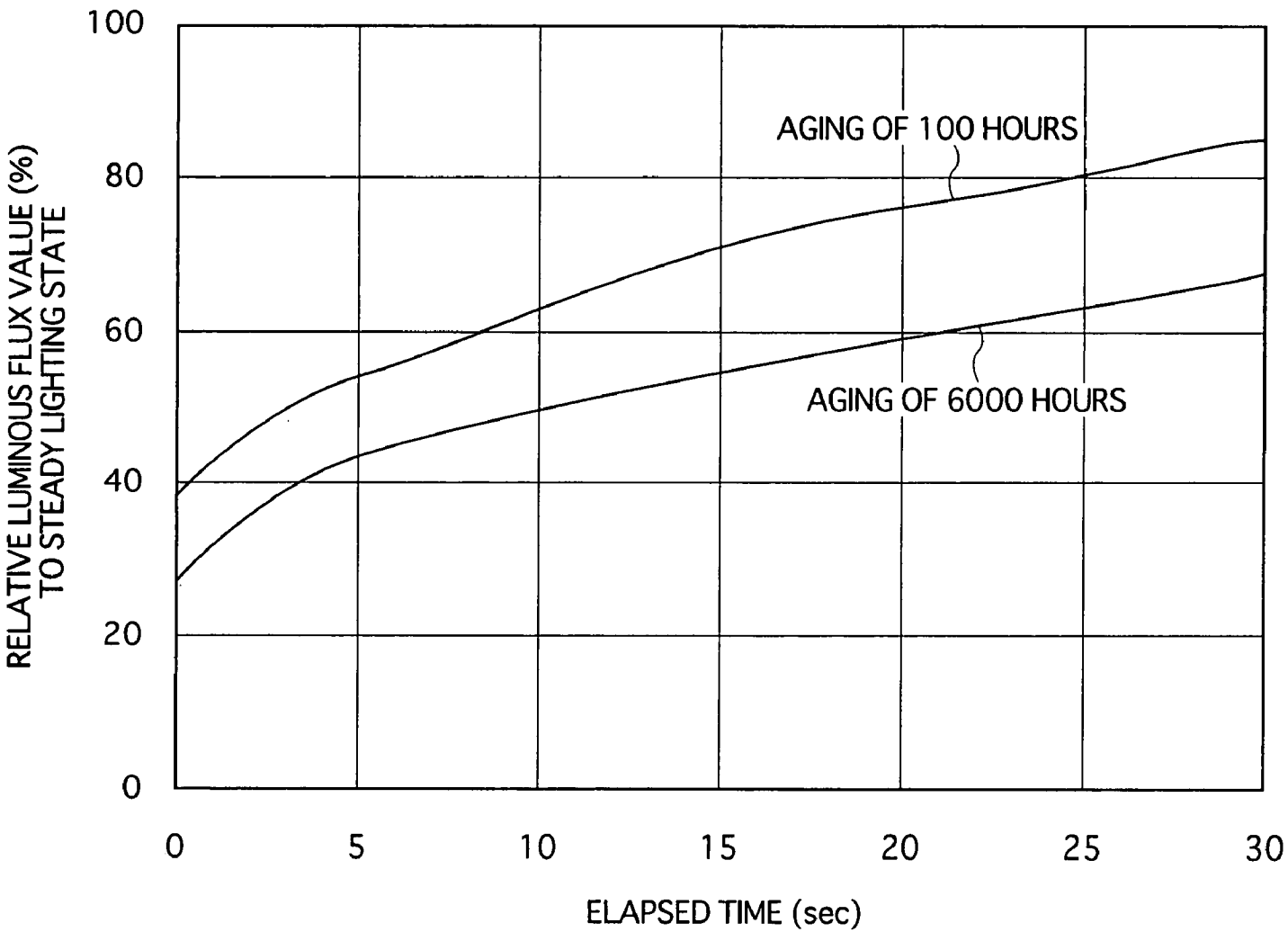
FIG. 1 is a graph showing rising characteristics of a conventional compact self-ballasted fluorescent lamp at the lighting startup.
Figure 2:
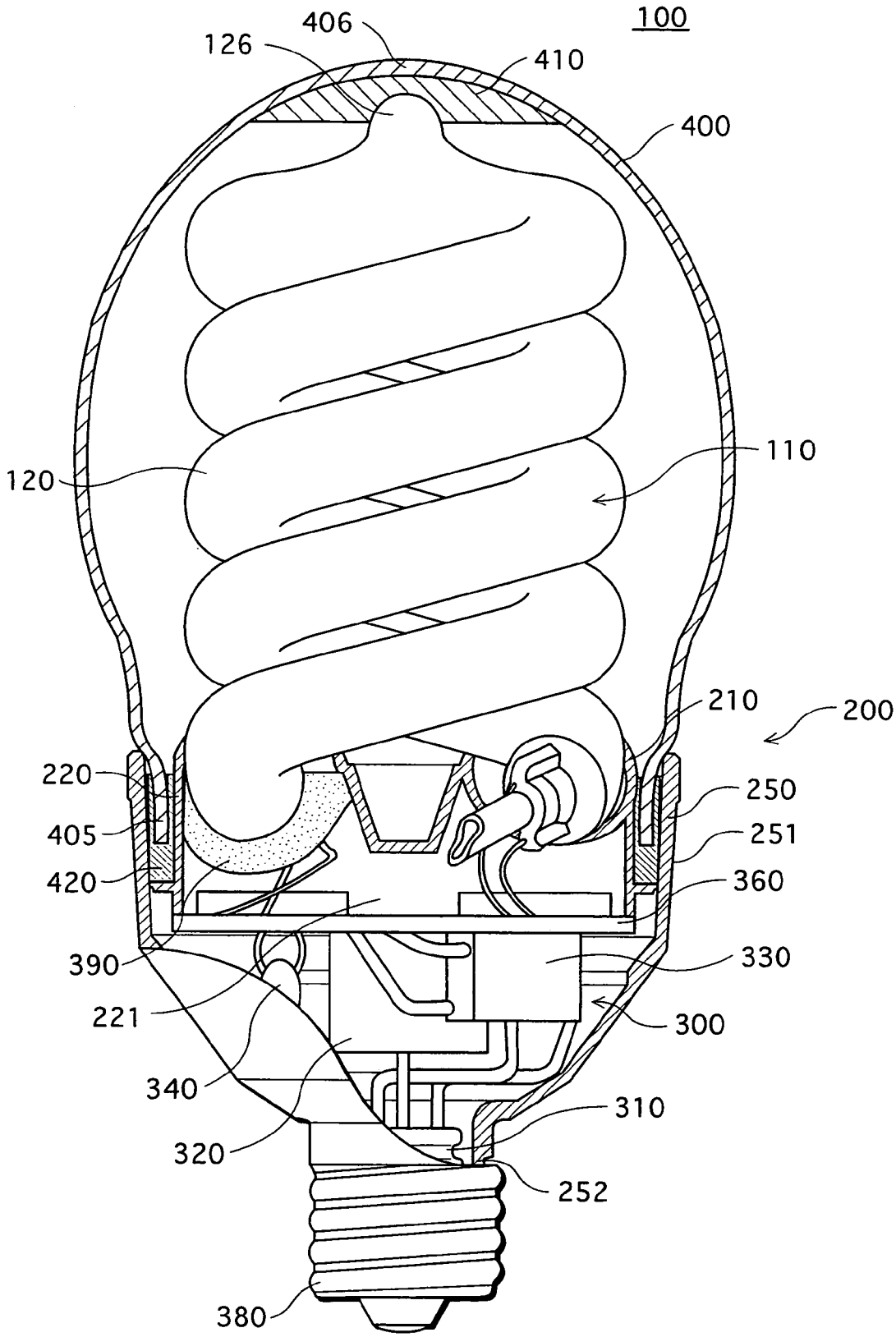
FIG. 2 is a front view of a compact self-ballasted fluorescent lamp relating to a preferred embodiment of the present invention, with being partially cut away.

As shown in FIG. 2, a compact self-ballasted fluorescent lamp 100 relating to the present embodiment includes an arc tube 110 formed by a glass tube 120 wound into a double-spiral shape, a holder 200 holding the arc tube 110, an electronic ballast 300 contained in the holder 200 for lighting the arc tube 110, and a globe 400 covering the arc tube 110.

The electronic ballast 300 employs a series-inverter method, and includes a plurality of electric components such as capacitors 310, 330, 340, and a choke coil 320. These electric components of the electronic ballast 300 are mounted on a substrate 360, which is attached to a holding member 210 described later.

The holder 200 includes the holding member 210 with a cylindrical shape having a closed bottom, and a case 250 that is fit to cover a circumferential wall of the holding member 210. The case 250 has a cone shape, and includes a cylindrical part with a larger opening (hereafter referred to as a large-diameter cylindrical part) 251, and a cylindrical part with a smaller opening (hereafter referred to as a small-diameter cylindrical part) 252. The large-diameter cylindrical part 251 is fit to cover the circumferential wall 220 of the holding member 210. To the small-diameter cylindrical part 252, the base 380 is attached.

As in the case of a globe used in incandescent lamps, the globe 400 is made from a glass material that can have a beautiful finish in its design, and is in the "A" shape. It should be noted here that the shape of the globe 400 should not be limited to the "A" shape.

The globe 400 is attached to the holding member 210 and the case 250 by placing its open end 405 between the circumferential wall 220 of the holding member 210 and the large-diameter cylindrical part 251 of the case 250 that is fit to cover the circumferential wall 220 of the holding member 210. The globe 400 is bonded via a bonding agent 420 filled between the holding member 210 and the case 250.

The inner surface of a top part 406 of the globe 400 is thermally connected to a projected part 126 formed at the top of the arc tube 110 via a heat-conductive medium 410, specifically, silicone resin.

(b) Arc Tube

Figure 3:
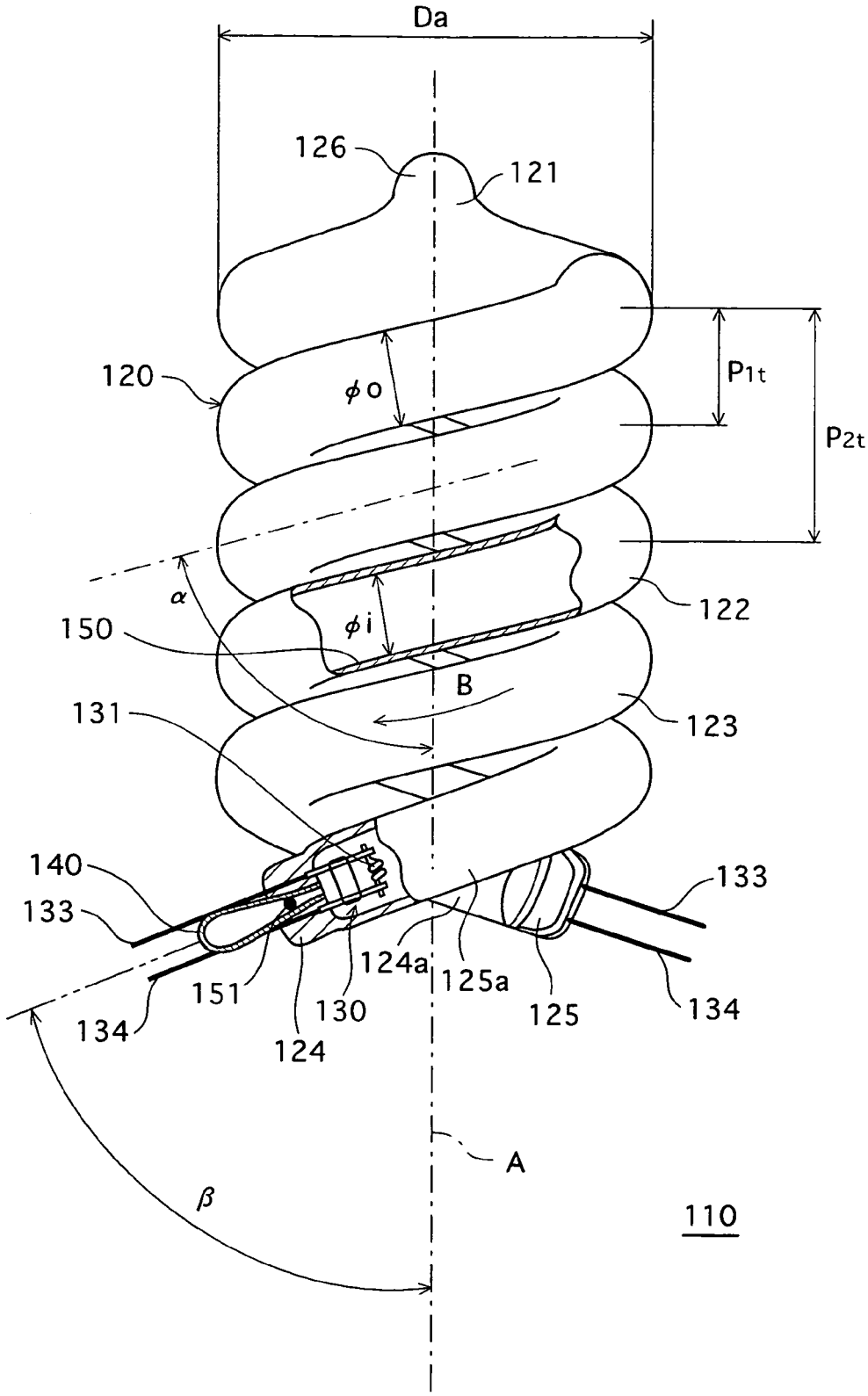
FIG. 3 is a front view of an arc tube relating to the embodiment of the present invention, with being partially cut away.

As shown in FIG. 3, the arc tube 110 has a double-spiral shape, and includes a turning unit 121 formed by turning the glass tube 120 at its middle, and two spiral units 122 and 123 formed by spirally winding glass tube parts that extend from the turning unit 121 to both ends 124 and 125 of the glass tube 120, in the B direction (this direction may be hereafter referred to as the "spiral direction") around the axis A of spiral (spiral axis A). It should be noted here that the ends 124 and 125 of the glass tube 120 referred to in this specification intend to mean the very edges of both ends of the glass tube 120. It should be noted here that the direction parallel to the spiral axis A is hereafter referred to as the "spiral-axis direction".

The glass tube 120 (specifically, each of the spiral units 122 and 123) is wound with substantially the same pitch, i.e., a first pitch, from its middle (corresponding to the turning unit 121) to a predetermined position (hereafter referred to as a "pitch enlarging position"), and with a second pitch larger than the first pitch from the pitch enlarging position to the ends 124 and 125 of the glass tube 120 (the parts of the glass tube 120 from the pitch enlarging position to the ends 124 and 125 may be hereafter referred to as "end-vicinity parts"). Due to the second pitch, the ends 124 and 125 are away from glass tube parts that are adjacent to the ends 124 and 125 in the spiral-axis direction. A "pitch" referred to herein is "P1t" in FIG. 3, and is specifically a distance between the central points of the cross sections of two glass tube parts adjacent to each other in the spiral-axis direction.

To be more specific, the glass tube 120 is wound at an inclination angle $\alpha$ with respect to the spiral axis A (hereafter referred to as the "spiral angle"), from its middle (corresponding to the turning unit 121) to the pitch enlarging position, and at an inclination angle $\beta$ smaller than the inclination angle $\alpha$ with respect to the spiral axis A from the pitch enlarging position to the ends 124 and 125.

It should be noted here that soft glass such as strontium-barium silicate glass is used as a material for the glass tube 120.

Electrodes 130 are sealed at the ends 124 and 125 of the glass tube 120. The electrodes 130 each are composed of a filament coil 131 and a pair of lead wires 133 and 134 supporting the filament coil 131 by a bead glass mounting method. The filament coils 131 are made of tungsten formed into a triple spiral shape, and an amount of for example 2 mg of an electron emissive material mainly composed of BaO—CaO—SrO is filled thereon. The electrodes 130 are sealed in such a manner that the filament coils 131 are inserted into the glass tube 120 to such positions away by a predetermined distance from the ends 124 and 125.

An exhaust tube 140 is sealed, together with the electrode 130, at one of the ends 124 and 125 of the glass tube 120, i.e., the end 124, to exhaust the glass tube 120 to create a vacuum therein or to enclose mercury, a buffer gas, or the like therein described later. The tip of the exhaust tube 140 is sealed for example by tip-off, after the glass tube 120 is exhausted and mercury and a buffer gas are enclosed.

Within the glass tube 120, about 3±0.3 mg of mercury, and argon as a buffer gas are enclosed at a pressure of 600 Pa. As the buffer gas, a mixture gas such as a mixture of argon and neon may also be used.

Mercury is enclosed in the glass tube 120 in such form that can exhibit a mercury vapor pressure value during lighting of the arc tube 110 equivalent to a mercury vapor pressure value exhibited by mercury that is substantially-singly enclosed. To be more specific, mercury is enclosed in the form of tin mercury (Sn—Hg) 151 that can exhibit a mercury vapor pressure value during lighting close to a mercury vapor pressure value exhibited by substantially single mercury.

It should be noted here that mercury, for example, an alloy of mercury and tin, enclosed in the glass tube 120 is referred to as "mercury in substantially single form" as long as the mercury has substantially the same action as singly enclosed mercury.

As the tin mercury 151, an alloy of 80 wt % tin and 20 wt % mercury is used. It should be noted here that the mercury exhibiting a mercury vapor pressure value equivalent to a mercury vapor pressure value exhibited by mercury in substantially single form during lighting of the arc tube 110 may be zinc mercury (Zn—Hg), in addition to tin mercury mentioned above.

A phosphor 150 is applied to the inner surface of the glass tube 120. The phosphor 150 used here may be a mixture of three types of rare-earth phosphors respectively emitting red, green, and blue light, e.g., $Y_2O_3$:Eu, $LaPO_4$:Ce, Tb, and $BaMg_2Al_{16}O_{27}$:Eu, Mn.

(c) Holder

Figure 4A:
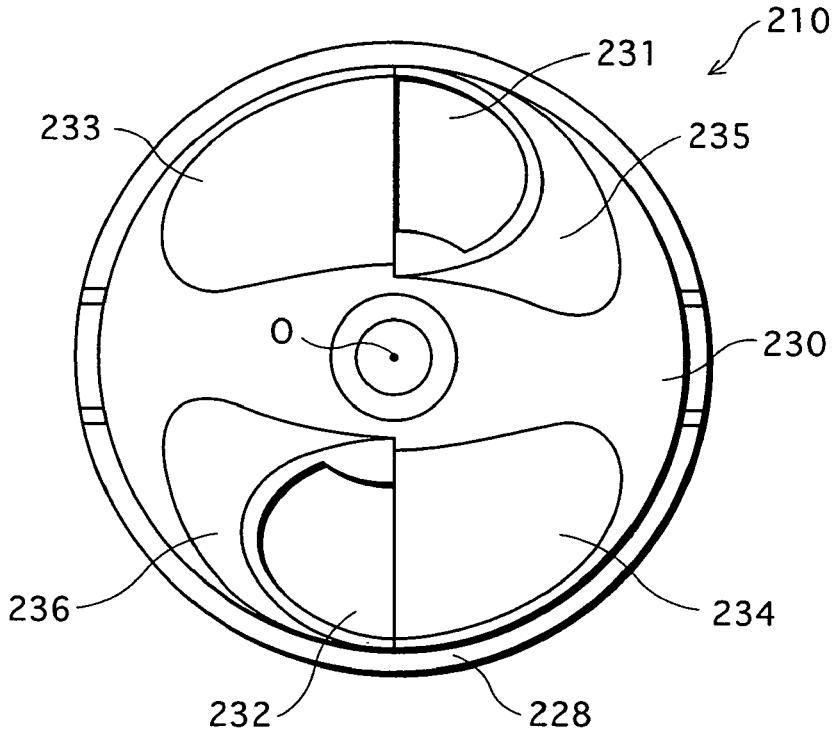
FIG. 4A is a plan view of a holding member relating to the embodiment of the present invention.
Figure 4B:
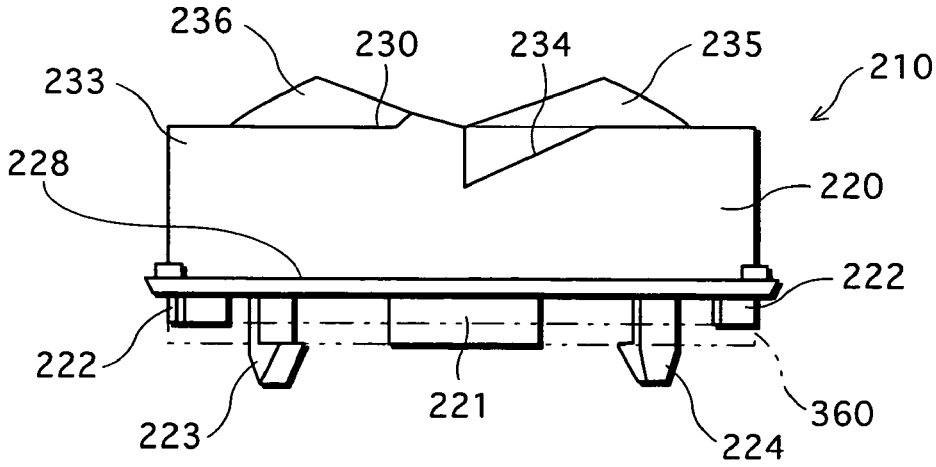
FIG. 4B is a side view of the holding member relating to the embodiment of the present invention.

As shown in FIGS. 2, 4A, and 4B, the holding member 210 is roughly composed of an end wall 230 and a circumferential wall 220. As one example, PET (polyethylene terephthalate) is used as a material for the holding member 210. This resin has good heat-resistant properties, and also has strong resistance to ultraviolet rays.

The following first describes the end wall 230. The end wall 230 has a pair of insertion openings 231 and 232 through which the ends 124 and 125 of the glass tube 120 are inserted into the holding member 210, a pair of guide units 233 and 234 for guiding the ends 124 and 125 of the glass tube 120 to the insertion openings 231 and 232, and a pair of cover units 235 and 236 for covering the end-vicinity parts 124*a* and 125*a* of the inserted glass tube 120.

The insertion openings 231 and 232, the guide units 233 and 234, and the cover units 235 and 236 are formed as symmetric pairs with respect to a central point 0 of the end wall 230. Hereafter, the side toward which the end 124 (125) of the glass tube 120 moves in the process of inserting the glass tube 120 into the holding member 210 is referred to as the "slower side", and the side opposite to the lower side is referred to as the "supper side".

At the upper sides of the insertion openings 231 and 232, the guide units 233 and 234 are formed. The guide units 233 and 234 are formed as grooves that are recessed from the surface of the end wall 230, to have such shapes that correspond to the outer shapes of the lower portions of the end-vicinity parts 124*a* and 125*a* of the glass tube 120.

The guide units 233 and 234 come in contact with the outer surfaces of the lower portions of the ends 124 and 125 of the glass tube 120, and guide the ends 124 and 125 to the insertion openings 231 and 232 when the arc tube 110 is rotated around the central axis of the holding member 210 in a state where the spiral axis A of the arc tube 110 matches the central axis of the holding member 210.

At the lower sides of the insertion openings 231 and 232, the cover units 235 and 236 are formed. The cover units 235 and 236 are formed as arches projecting from the surface of the end wall 230 to have such shapes that correspond to the outer shapes of the upper portions of the end-vicinity parts 124*a* and 125*a* of the glass tube 120. The arches are formed lower as being less closer to the insertion openings 231 and 232.

The insertion openings 231 and 232 are specifically formed by both the lower-side edges of the guide units 233 and 234 and the upper-side edges of the cover units 235 and 236. As shown in FIG. 4B, the upper-side edges of the cover units 235 and 236 are inclined toward the lower-sides with respect to the central axis of the holding member 210 as viewed from side of the holding member 210. As shown in FIG. 4A, the insertion openings 231 and 232 open as viewed from above.

The following then describes the circumferential wall 220 of the holding member 210. As shown in FIG. 2 and FIG. 4B, a pair of substrate supporting units 222, a pair of substrate engagement units 223 and 224, and a pair of contact units 221 are formed on the circumferential wall 220 of the holding member 210. The substrate supporting units 222 are for supporting the substrate 360 on which the electronic ballast 300 is mounted. The substrate engagement units 223 and 224 are to be engaged at one surface of the substrate 360 closer to the base 380. The contact units 221 are for coming in contact with the peripheral edge of the substrate 360.

On the entire peripheral edge of the opening of the circumferential wall 220 (opposite to the end wall 230), a flange unit 228 is formed to project outward. The flange unit 228 is engaged with projected parts (not shown) formed at the inner surface of the case 250, so that the holding member 210 and the case 250 are combined together.

Figure 5:
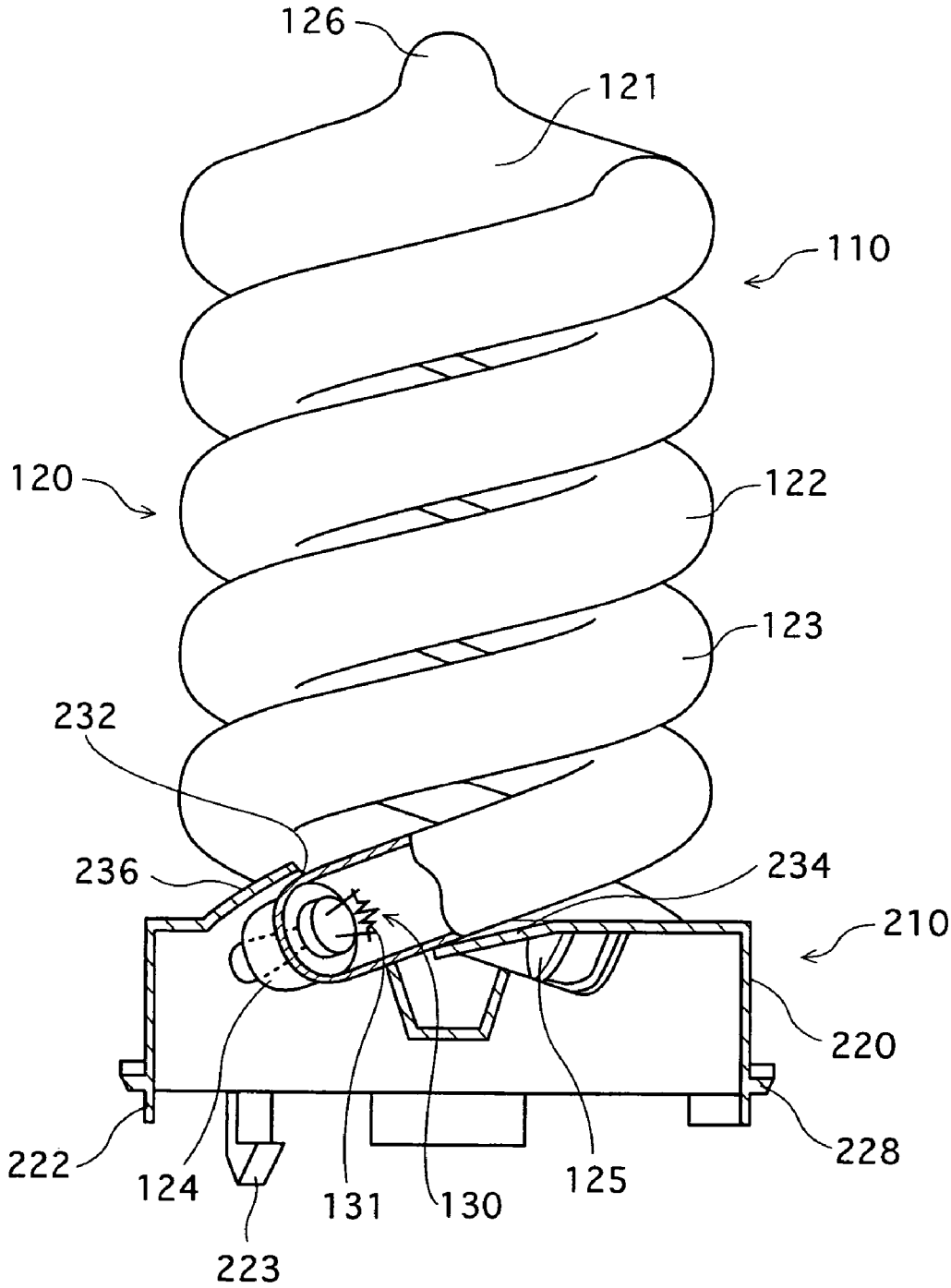
FIG. 5 is a front view of the arc tube held by the holding member relating to the embodiment of the present invention.

The following describes the state where the holding member 210 with the above-described construction holds the arc tube 110. The holding member 210 holds the arc tube 110 by bonding the end-vicinity parts 124*a* and 125*b* (which may include the ends 124 and 125) of the glass tube 120 inserted through the insertion openings 231 and 232 as shown in FIG. 5 and FIG. 6, to the inner surface of the holding member 210 via silicone resin 390 or the like as shown in FIG. 2.

Here, the filament coils 131 placed in the glass tube 120 are positioned within the holding member 210. As shown in FIG. 6, the minimum distance L1 between (a) the filament coil 131 and (b) the edge of the insertion opening 231 (232) of the holding member 120 in the direction where the end 124 (125) of the glass tube 120 is inserted (insertion direction), is set in a range of 0 to 10 mm inclusive. Here, even when the minimum distance L1 is 0 mm, i.e., when half portions of the filament coils 131 are positioned within the holding member 210, the filament coils 131 are assumed to be positioned within the holding member 210.

Figure 6:
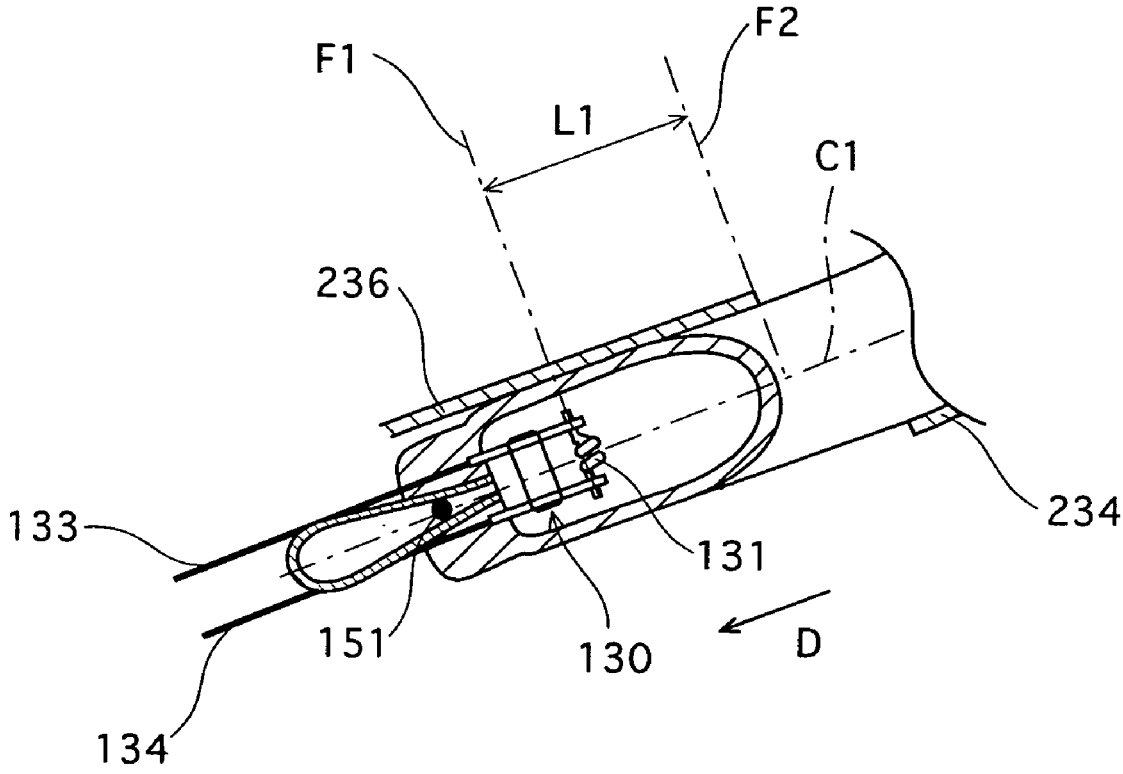
FIG. 6 is an enlarged view of an end-vicinity part of a glass tube inserted in the holding member relating to the embodiment of the present invention.
Figure 7:
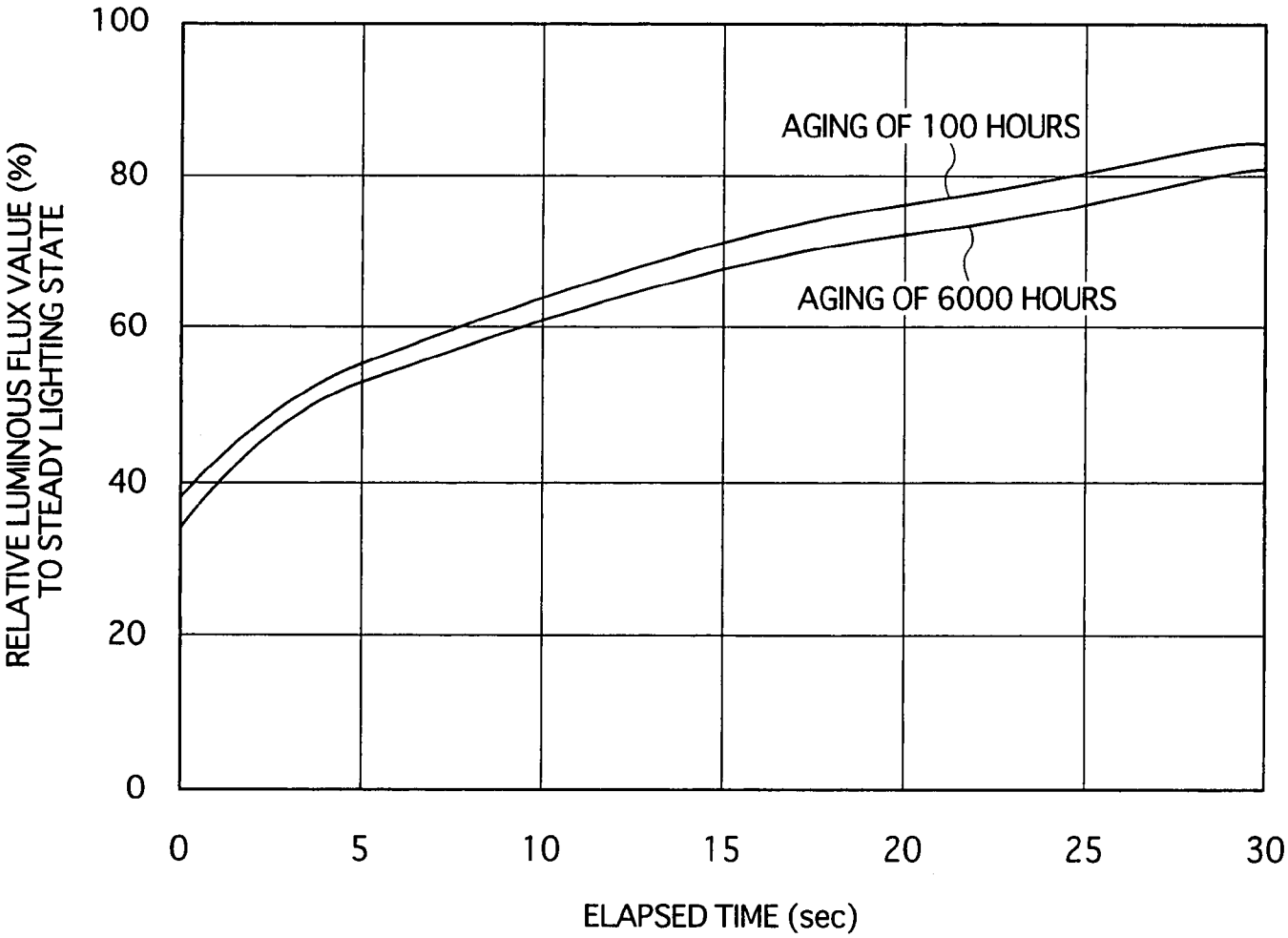
FIG. 7 is a graph showing rising characteristics of the compact self-ballasted fluorescent lamp relating to the embodiment of the present invention at the lighting startup.

As shown in FIG. 6, the minimum distance L1 is a distance between a plane F1 and a plane F2 in the insertion direction D of the glass tube 120. The plane F1 is a plane that includes positions on the filament coil 131 that are supported by the lead wires 133 and 134, and that is perpendicular to the tubular axis C1 of the glass tube 120. The plane F2 is a plane that includes positions, closest to the filament coil 131 in the insertion direction D, on the boundary at which the glass tube 120 inserted through the insertion openings 231 and 232 enters in the holding member 210 (the edges of the insertion openings 231 and 232), and that is perpendicular to the tubular axis C1.

Here, the positioning of the filament coils 131 is expressed using their minimum distance L1 from the edges of the insertion openings 231 and 232 respectively, due to the following reason. The edges of the insertion openings 231 and 232 are inclined with respect to the central axis of the holding member 210 (see FIG. 4B), in such a manner that the insertion openings 231 and 232 are open as viewed from above the holding member 210 (see FIG. 4A). In this case, the distance between (a) the filament coils 131 positioned within the holding member 210 and (b) the edges of the insertion openings 231 and 232 respectively varies depending on the positions on the edges of the insertion openings 231 and 232.

2. Specific Constructions

The compact self-ballasted fluorescent lamp 100 relating to the present embodiment corresponds to a 60W incandescent lamp. Therefore, an arc tube having spiral units 122 and 123 wound by 4.5 winds together is used as the arc tube 110, and an E17-type base is used as the base 380.

The compact self-ballasted fluorescent lamp 100 (globe 400) has a maximum diameter D of 55 mm, and a total length L of 108 mm, which is smaller than incandescent lamps whose maximum diameter is 60 mm and total length is 110 mm.

For the lamp performances, the compact self-ballasted fluorescent lamp 100 exhibits the luminous flux of 820 lm and the luminous efficiency of 68.3 lm/W when the lamp input is 12W. In the life test, the compact self-ballasted fluorescent lamp 100 is confirmed to satisfy a targeted value of 6000 hours.

The following describes the dimensions of the arc tube 110, with reference to FIG. 3.

The arc tube 110 has an annular outer diameter Da, i.e., a diameter of the arc tube 110 at an outermost circumference of the spirally wound glass tube 120, being 36.5 mm, a tube inner diameter $\phi i$ of the glass tube 120 being 7.4 mm, and a tube outer diameter $\phi o$ of the glass tube 120 being 9 mm. It is preferable that the annular outer diameter Da of the arc tube 110 is in a range of 30 to 40 mm inclusive, to make the arc tube 110 substantially equal in size to incandescent lamps.

It is preferable that the tube outer diameter $\phi o$ of the glass tube 120 is smaller than 10 mm. This is due to the following reason. When the tube outer diameter $\phi o$ is 10 mm or larger, the glass tube 120 has large flexural rigidity, and therefore, it is difficult to spirally wind the glass tube 120 to have the annular outer diameter Da of as small as about 36.5 mm.

The pitch enlarging position is such a position back from the end 124 (125) by 90° with respect to the spiral axis as viewed from below the spirally-wound glass tube 120. Between the turning unit 121 to the pitch enlarging position, the spirally-wound glass tube 120 has a pitch P2t of 20 mm and a pitch P1t of 10 mm. The pitch P2t is a pitch of parts of the spiral unit 122 adjacent in the spiral-axis direction or a pitch of parts of the spiral unit 123 adjacent in the spiral-axis direction (vertical direction in FIG. 3). The pitch P1t is a pitch of a part of the spiral unit 122 and a part of the spiral unit 123 adjacent in the spiral-axis direction.

Accordingly, a minimum gap between glass tube parts adjacent in the direction parallel to the spiral axis A is about 1 mm. It is preferable that this gap is 3 mm or smaller. This is due to the following reason. When the gap is larger than 3 mm, the total length of the arc tube 110 is inevitably long, and also, adjacent glass tube parts are so apart from one another that the problem of uneven illuminance occurs.

The spiral angle $\alpha$ employed between the turning unit 121 to the pitch enlarging position is about 76.7°. The spiral angle $\beta$ employed between the pitch enlarging position and the ends 124 and 125 is about 69.2°.

The distance between the electrodes 130 (between the filament coils 131) within the arc tube 110 is 400 mm. The total length of the arc tube 110 (the distance from the tip of the projected part 126 of the arc tube 110 to its bottom end where the electrodes are sealed in the direction parallel to the spiral axis A) is 62.8 mm.

The circumferential wall 220 of the holding member 210 has an outer diameter of 38.5 mm and a height of about 14.6 mm.

On the other hand, in a state where the glass tube 120 with the above-described construction is held by the holding member 210, the minimum distance L1 between the filament coil 131 within the glass tube 120 and the edge of the insertion opening 231 (232) is 6 mm. Also, the electrodes 130 are sealed in the glass tube 120 in a state where the filament coils 131 are inserted into the glass tube 120 to such positions away from the ends of the glass tube 120 by about 14 mm.

It should be noted here that although the present invention is applied to the compact self-ballasted fluorescent lamp corresponding to a 60W incandescent lamp, the present invention may be applied to compact self-ballasted fluorescent lamps corresponding to incandescent lamps with other wattages. In this case, the dimensions of the arc tube, the total length of the compact self-ballasted fluorescent lamp, the type of the base, etc., are different from those described in the above embodiment.

3. Rising Characteristics (a) Rising Characteristics Test

A test to examine rising characteristics at the lighting startup was conducted on the compact self-ballasted fluorescent lamp 100 with the above-described construction. The compact self-ballasted fluorescent lamp 100 with the above-described construction is hereafter referred to as the "present invention", and the compact self-ballasted fluorescent lamp described in the Related Art is referred to as the "conventional lamp" to different it from the "present invention".

As described in the Problems to be Resolved by the Invention, the present invention was lit after the total lighting time of 100 hours and 6000 hours. The relationship between (a) a luminous flux value relative to a luminous flux value during the steady lighting state and (b) an elapsed lighting time was examined. It should be noted here that in this test the lamps were lit with its base being oriented upward.

As shown in the figure, the rising characteristics of the present invention are such that the time required by the relative luminous flux value to reach 60% is about 7.5 seconds for the total lighting time of 100 hours (the same as that for the conventional lamp), but is about 9 seconds for the total lighting time of 6000 hours.

Comparing the present invention and the conventional lamp in terms of the time required by the relative luminous flux value to reach 60% after the total lighting time of 6000 hours, the time is 20.5 seconds for the conventional lamp and 9.5 seconds for the present invention, implying that the present invention shows a great improvement.

(b) Amount of Mercury in the Glass Tube

For the present invention, an analysis of component was conducted at positions, in the vicinity of the filament coil 131, on the inner surface of the glass tube 120 after the total lighting time of 6000 hours. The analytical result indicates that 20 to 30% of mercury enclosed in the arc tube 120 sputtered and evaporated from the filament coil 131, and reacted with an electron emissive material adhered to the inner surface of the glass tube 120 to form one type of amalgam (molecular absorption spectrometry was used for the analysis).

For the conventional lamp, too, the same analysis was conducted at positions, in the vicinity of the filament coil 131, on the inner surface of the glass tube 120 after the total lighting time of 6000 hours. The analytical result indicates that 50 to 70% of mercury enclosed in the arc tube sputtered and evaporated from the filament coil, and reacted with an electron emissive material adhered to the inner surface of the glass tube to form one type of amalgam.

(c) Conclusions

For the present invention after the total lighting time of 6000 hours, mercury enclosed in the glass tube is reduced by a smaller amount, and also better rising characteristics are obtained as compared with the conventional lamp. Due to this, the rising characteristics are considered to be affected by an amount of mercury present within the glass tube.

The following describes the reasons why the present invention can better suppress a reduction in the amount of mercury than the conventional lamp.

An electron emissive material applied to the filament coil usually sputters and evaporates due to lighting, and is adhered to the inner surface of the glass tube (this adhered material is hereafter referred to as "blackened material"). The position on the inner surface of the glass tube 120 to which the blackened material is adhered is within the holding member 210 for the present invention, whereas the position is outside the holding member for the conventional lamp.

During the OFF time, the temperature in the vicinity of the blackened material adhered to the inner surface of the glass tube is higher for the present invention than for the conventional lamp. Further, the temperature at the inner surface of the glass tube is lowered less for the present invention than for the conventional lamp. Accordingly, the temperature of the blackened material adhered to the inner surface of the glass tube 120 is higher for the present invention than for the conventional lamp.

On the other hand, mercury has a property of gathering toward lower-temperature positions. It is considered that, even after the compact self-ballasted fluorescent lamp is made OFF, the temperature of the blackened material remains high for the present invention, and mercury within the glass tube does not gather around the blackened material, and therefore, the reaction between the blackened material and mercury is suppressed.

For the present invention, therefore, the amount of mercury consumed within the glass tube along with longer hours of the total lighting time can be reduced. Due to this, the rising characteristics at the initial use of the lamp can be maintained at a high rate, and the rising characteristics after the lighting time of long hours can be greatly improved.

4. Other Matters (a) Position of the Filament Coil

Although the above embodiment describes the case where the minimum distance L1 between the filament coil and the edge of the insertion opening is 6 mm, the minimum distance L1 may be in a range of 0 to 10 mm inclusive.

This range is determined due to the following reason. When the minimum distance L1 is smaller than 0 mm (where the filament coil is positioned outside the holding member), the effect of improving the rising characteristics at the lighting startup after the total lighting time of long hours cannot be sufficiently obtained. When the minimum distance L1 is larger than 10 mm, the luminous flux produced by the arc tube is reduced by more than 5% of the luminous flux of the compact self-ballasted fluorescent lamp in which the filament coil is positioned outside the holding member. This is not preferable in view of maintaining the quality of the lamp.

(b) Amount of Mercury Enclosed in the Arc Tube

The inventors of the present application first attributed the degradation of the rising characteristics at the lighting startup after the total lighting time of long hours, to the reduction in the amount of mercury caused by the reaction between the blackened material adhered to the inner surface of the glass tube and mercury.

The inventors then conducted the same rising characteristics test on the conventional lamp (in which the filament coil is positioned outside the holding member) by increasing an amount of mercury enclosed within the glass tube to 8 mg. As a result, the rising characteristics at the lighting startup were not degraded after the total lighting of long hours. However, the blackened material was adhered, in the vicinity of the filament coil, to the inner surface of the glass tube, and an amalgam was formed there.

It seems that the problem can be solved by adding an amount of mercury to be reacted with the blacked material adhered to the inner surface of the glass tube, to the amount of mercury to be enclosed in the glass tube. In view of environmental protection, however, the recent trend is to reduce the amount of mercury, which is a toxic substance, enclosed in the glass tube. The present invention can effectively suppress consumption of mercury within the glass tube by holding the arc tube in a state where the filament coil is positioned within the holding member, and can provide an effective means of reducing the amount of mercury to be enclosed.

Although the above embodiment describes the case where 3 mg of mercury is enclosed in the glass tube, the amount of mercury to be enclosed may be in a range of 2 to 5 mg. This range is determined due to the following reason. When the enclosed amount of mercury is smaller than 2 mg, a sufficient amount of mercury does not present in the glass tube. Also, even when the enclosed amount of mercury is larger than 5 mg, an amount of mercury present in the glass tube at the lighting is substantially the same as when the enclosed amount is 5 mg or smaller, due to the mercury vapor pressure within the glass tube.

<Modifications>

Although the present invention is described based on the above embodiment, the contents of the present invention should not be limited to specific examples shown in the above embodiment. For example, the following modifications are possible.

1. Compact Self-Ballasted Fluorescent Lamp

It is known that an electron emissive material on a filament coil evaporates due to lighting, and is adhered to the inner surface of the glass tube in the vicinity of the filament coil. Mercury within the arc tube reacts with the blackened material (electron emissive material) adhered to the inner surface, regardless of for example whether a main amalgam or an auxiliary amalgam is provided or not, and whether a globe covering the arc tube is provided or not. Accordingly, the present invention is applicable to a compact self-ballasted fluorescent lamp in which a main amalgam and an auxiliary amalgam are provided in its glass tube, and further to a compact self-ballasted fluorescent lamp that does not include a globe covering its arc tube.

When the present invention is applied to a compact self-ballasted fluorescent lamp including a main (and/or auxiliary) amalgam in its glass tube, mercury present within the glass tube 120 returns to the amalgam without approaching to a blackened material when the lamp is made OFF, even after the total lighting time of long hours. Therefore, the rising characteristics of this compact self-ballasted fluorescent lamp are not degraded so much. In this sense, such an advantageous effect described in the above embodiment may not be produced in the case of this lamp.

2. Dimensions of the Arc Tube

Although the above embodiment describes the case where the arc tube has a double-spiral shape formed by a glass tube wound from its middle to both ends around one axis, the arc tube may have another shape.

Figure 8A:
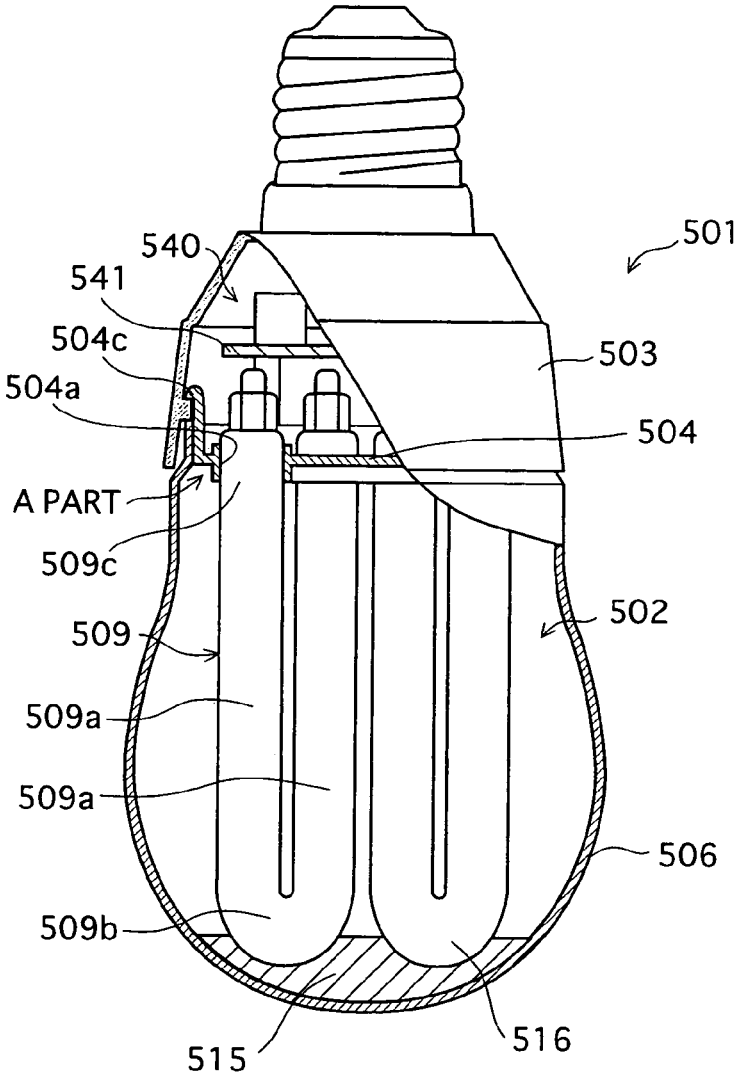
FIG. 8A is a front view of a compact self-ballasted fluorescent lamp relating to a modification of the present invention, with being partially cut away.

For example, the arc tube may have a "4U construction" in which four U-shaped glass tubes are combined together as shown in FIG. 8A. The following briefly describes a compact self-ballasted fluorescent lamp 501 including an arc tube 502 having the 4U construction, with reference to FIGS. 8A and 8B.

The glass tube 509 has the above-described U shape, and is composed of a pair of straight parts 509*a* and a bent part 509*b* joining one ends of the straight tube parts 509*a*. The arc tube 502 is formed by placing the four glass tubes 509 in a substantially square shape so that the glass tubes 509 surround the central axis of an axial case 503 as their substantially center as viewed in the direction of the central axis of the axial case 503, and bridge-connecting adjacent ones of the other ends of the straight parts 509*a* except one pair. At the other end of the one pair of straight parts 509*c*, electrodes 530 that are the same as the electrodes described in the above embodiment are sealed.

The holding member 504 is a flat plate member, and has eight insertion openings 504*a* through which the other ends of the straight parts 509*a* of the glass tubes 509 constituting the arc tube 502 are inserted. The holding member 504 has, a holding cylinder 504*b* surrounding each insertion opening 504*a* for holding the straight parts 509*a* of the glass tubes 509.

The holding member 504 has substrate engagement hooks to be engaged with a substrate 541 on which an electronic ballast 540 is mounted, and case engagement hooks 504*c* to be engaged at the inner surface of a case 503. The method of attaching the holding member 504 to the substrate or to the case should not be limited to such a engagement method, but may for example be a method using screws.

Figure 8B:
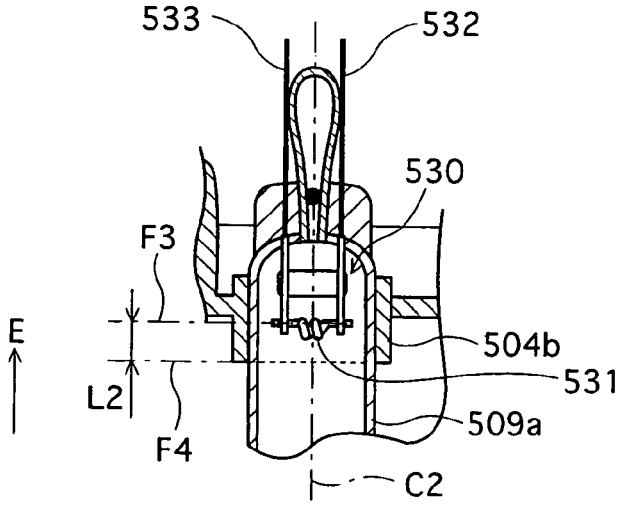
FIG. 8B is an enlarged sectional view of "A" part shown in FIG. 8A.

As shown in FIG. 8B, for the arc tube 502, the filament coil 531 within the glass tube 509 is positioned at the side of the holding member 504 where the case 503 is positioned. The minimum distance L2 between the filament coil 531 and the edge of the insertion opening 504*a* in the insertion direction E of the glass tube 509 inserted through the insertion opening 504*a* is in a range of 0 to 10 mm inclusive.

The minimum distance L2 is a distance between a plane F3 and a plane F4 in the insertion direction E. The plane F3 is a plane that includes positions on the filament coil 531 that are supported by the lead wires 532 and 533, and that is perpendicular to the tubular axis C2 of the glass tube 509. The plane F4 is a plane that includes positions, closest to the filament coil 531 in the insertion direction E, on the boundary at which the glass tube 509 enters in the holding member 504 (the holding cylinder 504*b*), and that is perpendicular to the tubular axis C2.

As in the above embodiment, the degradation of the rising characteristics which occurs to the conventional lamp after the total lighting time of long hours does not occur to the compact self-ballasted fluorescent lamp 501 with this construction.

3. Main Amalgam

For the lamp of the present invention, the inner diameter of the glass tube may be at any value in a range of 5 to 9 mm. By connecting the top part of the arc tube (the bent part of the glass tube) to the globe via silicone resin, and setting the inner diameter of the glass tube in this range, the temperature of the arc tube during lighting can be made substantially the same as such a temperature that enables the luminous flux produced by the arc tube to be substantially the maximum. Therefore, a high luminous efficiency can be obtained even without utilizing a main amalgam. Further, because the lamp of the present invention does not use a main amalgam, the rising characteristics during lighting can be made similar to the rising characteristics of typical fluorescent lamps.

4. Electrodes

Although the above embodiment describes the case where the electrodes having such a construction where the filament coil is supported using the bead glass mount method are used, electrodes using other methods, e.g., a stem method, may instead be used.

5. Holding Member

The above embodiment describes the case where the holding member has, on its end wall, a pair of tube-holding structures each including the insertion opening, the guide unit, and the cover unit. Although it is preferable that the tube-holding structure includes all of the insertion opening, the guide unit, and the cover unit, the tube-holding structure may not include, for example, the guide unit. In this case, an opening is to be formed instead of the guide unit, to serve as the insertion opening. Alternatively, the tube-holding structure may not include the cover unit. In this case, an opening is to be formed instead of the cover unit, to serve as the insertion opening.

6. Fluorescent Lamp

Figure 9:
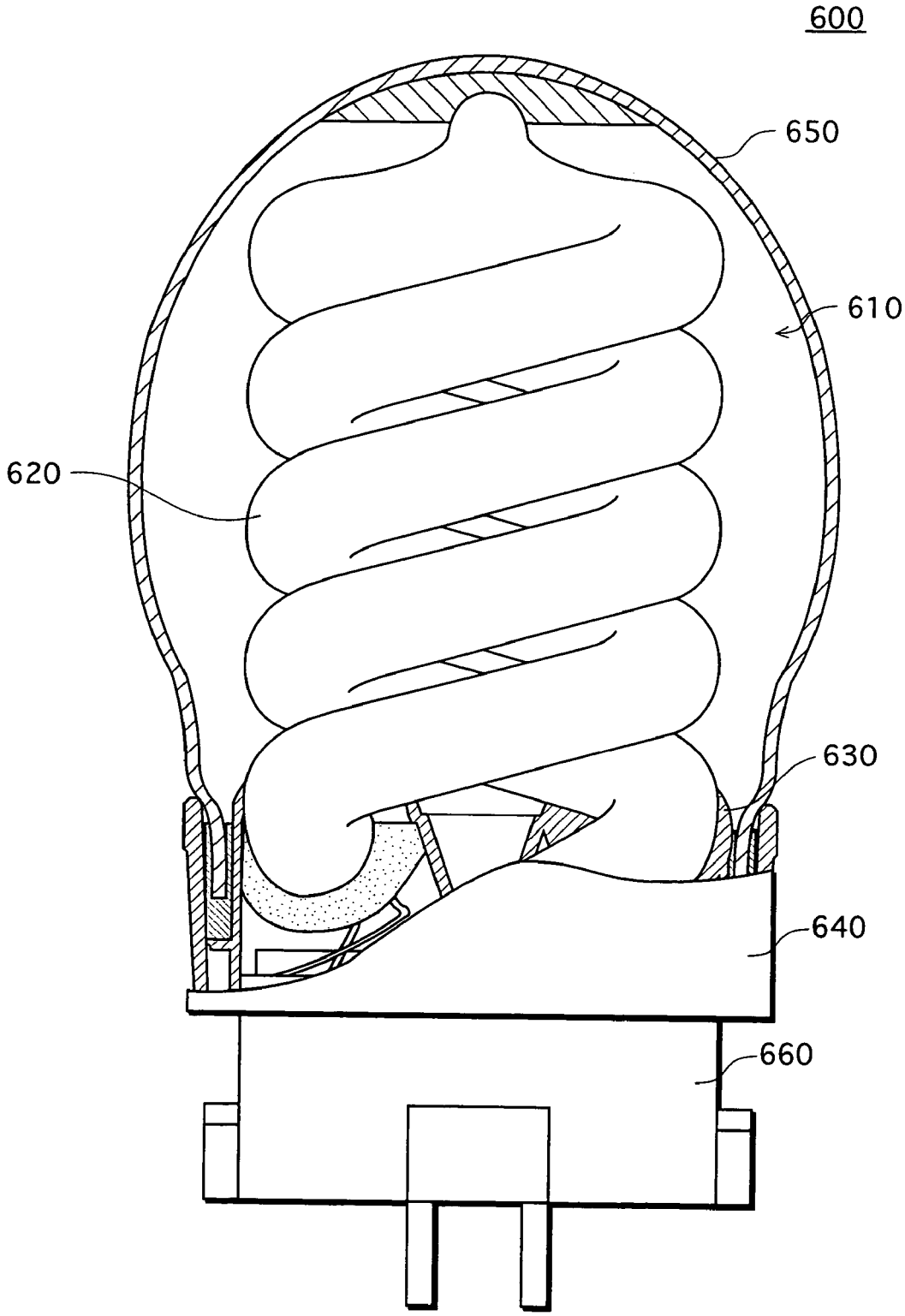
FIG. 9 is a front view of a fluorescent lamp to which the present invention is applied.

Although the above embodiment describes the case where the present invention is applied to a compact self-ballasted fluorescent lamp, the present invention can be applied for example to a fluorescent lamp shown in FIG. 9.

This fluorescent lamp 600 includes a double-spiral arc tube 610 formed by a glass tube 620 spirally wound to its ends, a cylindrical holding member 630 having a closed bottom and holding the arc tube 610 (the end-vicinity parts of the glass tube 620), a case 640 fit to cover the circumferential wall of the holding member 630, a globe 650 covering the arc tube 610, and a single base 660 (e.g., GX10q type) to be fit in a socket of a lighting fixture and receiving power supply.

The fluorescent lamp 600 differs from the above compact self-ballasted fluorescent lamps 100 and 501 in that an electronic ballast is not contained in the holding member 630 and the case 640, and in that the base 660 is not a screw-type base used also for incandescent lamps.

(a) Dimensions of the Arc Tube

The above embodiment describes the case where the present invention is applied to a compact self-ballasted fluorescent lamp alternative to an incandescent lamp. Therefore, the compact self-ballasted fluorescent lamp is described to have the above dimensions, in particular, the annular outer diameter of the double-spiral shape being 40 mm or smaller, down to about 30 mm. When the present embodiment is applied to the above fluorescent lamp, however, the above limitations on the dimensions of the arc tube can be removed. As one example, the annular outer diameter of the arc tube may be larger than 40 mm.

The spiral angle $\alpha$ employed between the middle of the glass tube and the pitch enlarging position and the spiral angle $\beta$ employed between the pitch enlarging position to the ends are determined depending on the targeted annular outer diameter and spiral pitch of the arc tube. If, for example, the targeted annular diameter of the arc tube is increased, the spiral angles $\alpha$ and $\beta$ are changed accordingly.

7. Holder

The holding member relating to the above embodiment holds the arc tube by bonding the ends of the glass tube to the inner surface of the holder via silicone resin. The ends of the glass tube are inserted in the holding member through the insertion openings formed in the end wall of the holding member. Also, for the compact self-ballasted fluorescent lamp relating to the modification 2 and the fluorescent lamp relating to the modification 5, too, the holding member having the same construction as that described in the above embodiment is used to hold the arc tube.

On the other hand, the holder of the present invention holds the arc tube by fixing the glass tube inserted through the insertion openings. In the above embodiment and the modifications, the holder is composed of the holding member and the case.

Accordingly, the construction of the holder of the present invention should not be limited to the construction described in the above embodiment and the modifications. For example, the holder may be such that the large-diameter part of the case is fit at the inner surface of the circumferential wall of the holding member. Further, separate members may be provided as a member where the insertion openings are formed and a member for fixing the glass tube. To be more specific, a plate member in which the insertion openings are formed and a cylindrical member to which the ends of the glass tube are fixed may be provided separately, and these separate members may be individually attached to the case.

8. Globe

Although the compact self-ballasted fluorescent lamps 100 and 501 relating to the above embodiment and the modification 2 and the fluorescent lamp 600 relating to the modification 5 respectively include the globes 400, 506, and 650 covering the arc tubes 110, 502, and 610, the present invention can be applied to a compact self-ballasted fluorescent lamp without a globe, or to a fluorescent lamp without a globe.

For the compact self-ballasted fluorescent lamp without a globe or the fluorescent lamp without a globe, heat generated during lighting is directly released from the arc tube. By setting the tube inner diameter of the glass tube in a range of 5 to 9 mm inclusive, the temperature of the arc tube during lighting becomes substantially the same as such a temperature that enables the luminous flux produced by the arc tube to be substantially the maximum.

Although the present invention has been fully described byway of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fluorescent lamp, comprising:

an arc tube having a double-spiral construction including a glass tube wound from a middle to both ends thereof around one axis, and electrodes sealed at both ends of the glass tube, each electrode including a filament coil; and a holder having a pair of insertion openings formed therein, and holding the arc tube by fixing the ends of the glass tube inserted through the insertion openings, wherein the ends of the glass tube are inserted to such positions that enable each filament coil to be positioned within the holder, and a minimum distance L1, in an insertion direction of the ends cite glass tube, between each filament coil and an edge of corresponding one of the insertion openings is in a range of 0 to 10 mm inclusive.

2. The fluorescent lamp of claim 1, wherein mercury is singly enclosed in the glass tube, and an inner diameter of the glass tube is in a range of 5 to 9 mm inclusive.

3. The fluorescent lamp of claim 1, further comprising a globe covering the arc tube, wherein the arc tube is thermally connected to the globe via a heat conductive medium, at coolest position of the arc tube during lighting, or a position in a vicinity of the coolest position.

4. The fluorescent lamp of claim 3, wherein the holder is in a cylindrical shape and has an end wall where the insertion openings are formed, the compact self-ballasted fluorescent lamp further comprises a case that is fit to cover a circumferential wall of the holder, and the globe is fixed in a state where an opening end thereof is fit in a gap formed between the circumferential wall of the holder and the case, the glass tube is wound around the axis from a turning part to both ends of the glass tube.

5. The fluorescent lamp of claim 1, wherein an amount of 2 to 5 mg inclusive of mercury is enclosed in the glass tube.

6. The fluorescent lamp of claim 5, wherein a winding pitch of the glass tube is changed to enlarge at such a position back from each end by 60 to 120° inclusive with respect to the axis, as viewed in the direction of the axis.

7. The fluorescent lamp of claim 5, wherein a gap between the other adjacent spiral parts is in a range of 1 to 3 mm inclusive, and a distance between (a) a first point that is on each end and (b) a second point that faces the first point and that is on an outer surface of an adjacent spiral part in the direction of the axis, is in a range of 3 to 6 mm inclusive.

8. The fluorescent lamp of claim 1, wherein a pitch of (a) each of both end parts of the glass tube and (b) an adjacent spiral part in a direction of the axis is larger than a pitch of other adjacent spiral parts, to widen a gap between each end part and the adjacent spiral part.

9. The fluorescent lamp of claim 1, wherein an annular outer diameter of the arc tube with the double-spiral construction is in a range of 30 to 40 mm inclusive.

10. A compact self-ballasted fluorescent lamp, comprising:

an arc tube including a glass tube at least partially bent, and electrodes sealed at both ends of the glass tube, each electrode including a filament coil;

a holder having a pair of insertion openings formed therein, and holding the arc tube by fixing the ends of die glass tube inserted through the insertion openings, wherein the ends of the glass tube are inserted to such positions that enable each filament coil to be positioned within the holder, and a minimum distance L1, in art insertion direction of to ends of the glass tube, between each filament coil and en edge of corresponding one of the insertion openings is in a range of 0 to 10 mm inclusive; and a globe covering the arc tube, wherein the arc tube is thermally connected to the globe via a beat conductive medium, at a coolest position of the arc tube during lighting, or a position in a vicinity of the coolest position.

11. The compact self-ballasted fluorescent lamp of claim 10, wherein the holder is in a cylindrical shape and has an end wall where the insertion openings arc formed, the compact self-ballasted fluorescent lamp further comprises a case that is fit to cover a circumferential wail of the holder, and the globe is fixed in a state where an opening end thereof is fit in a gap formed between the circumferential wall of the holder and the case wherein the glass tube is wound around the axis from a turning part to both ends of the glass tube.

* * * * *